US007156974B2

(12) United States Patent
Strezov et al.

(10) Patent No.: US 7,156,974 B2
(45) **Date of Patent: *Jan. 2, 2007**

(54) METHOD OF MANUFACTURING TITANIUM AND TITANIUM ALLOY PRODUCTS

(75) Inventors: Les Strezov, Adamstown (AU); Ivan Ratchev, Georgetown (AU); Steve Osborn, Valentine (AU); Kannappar Mukunthan, Rankin Park (AU)

(73) Assignee: BHP Billiton Innovation Pty. Ltd., Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/486,723

(22) PCT Filed: Aug. 16, 2002

(86) PCT No.: PCT/AU02/01109

§ 371 (c)(1),
(2), (4) Date: Jul. 30, 2004

(87) PCT Pub. No.: WO03/016594

PCT Pub. Date: Feb. 27, 2003

(65) Prior Publication Data

US 2004/0247478 A1 Dec. 9, 2004

(30) Foreign Application Priority Data

Aug. 16, 2001 (AU) ..... PR7121

(51) Int. Cl.
*C25C 3/28* (2006.01)

(52) U.S. Cl. ..... 205/398

(58) Field of Classification Search ..... 205/366, 205/398; 419/40

See application file for complete search history.

(56) References Cited

U.S. PATENT DOCUMENTS 2,707,170 A * 4/1955 Wainer ..... 205/401
4,400,247 A * 8/1983 Ginatta ..... 205/354
4,622,079 A * 11/1986 Chang et al. ..... 148/501
4,875,985 A 10/1989 Donahue et al.
4,917,858 A * 4/1990 Eylon et al. ..... 419/28
4,964,973 A 10/1990 Donahue et al.
5,336,378 A * 8/1994 Nishimura et al. ..... 205/400
6,117,208 A * 9/2000 Sharma ..... 75/613
2003/0047462 A1 * 3/2003 Ward-Close et al. ..... 205/366

FOREIGN PATENT DOCUMENTS

GB 2359564 A 8/2001
JP 2001-11612 * 1/2001
WO WO 98/33956 A 8/1998
WO WO 99/64638 A 12/1999

OTHER PUBLICATIONS

"Electrochemical Deoxidation of Titanium" Metallurgical Transactions B, vol. 24B, Jun. 1993 Okabe et al., pp. 449-455.*

Direct Electrochemical Reduction of Titanium Dioxide to Titanium in Molten Calcium Chloride, Sep. 21, 2000, Nature 407, 361-364.*

* cited by examiner

*Primary Examiner*—Ngoclan T. Mai
(74) *Attorney, Agent, or Firm*—Miles & Stockbridge P.C.; Edward J. Kondracki

(57) ABSTRACT

A method of manufacturing titanium or titanium alloy semi-finished or ready-to-use products is disclosed. The method includes forming shaped bodies of titanium oxide particles and positioning the shaped bodies is an electrolytic cell which includes: an anode, a cathode, and a molten electrolyte. The shaped bodies are positioned to form at least a part of the cathode. The electrolyte includes cations of a metal that is capable of chemically reducing titanium oxide. The method further includes reducing the titanium oxide to titanium in a solid state in the electrolytic cell so that the shaped bodies become shaped bodies of titanium sponge. Finally, the method includes processing the shaped bodies of titanium sponge to reduce the volume or at least one of the dimensions of the bodies thereby to form the semi-finished or ready-to-use products.

38 Claims, 9 Drawing Sheets

Schematic of the Experimental Cell

Sintered Titanium Oxide Pellet

Structure of Metallic Titanium reduced from $TiO_2$

Oxygen Content of 0.05 wt%

Oxygen Content of 0.9 wt%

Appearance of the Metallic Titanium reduced from $TiO_2$ (99.95% pure)

Pellet Not suitable for Cold Processing

Hardness : 456 VHN

Oxygen : ~ 0.9 wt%

Pellet used for Further Processing

Hardness : 118 VHN

Oxygen : ~ 0.05 wt%

Cold Pressed
60% - 0.7 mm

Cold Pressed and Cold Rolled
75% - 0.4 mm

Reduced Pellet
1.7 mm

High Temperature Sintered for 150 min. at 1300° C

Cold Pressed 60%

Hot Pressed for 30 min. at 1000° C under 25 MPa

Cold Pressed 30%

METHOD OF MANUFACTURING TITANIUM AND TITANIUM ALLOY PRODUCTS

FIELD OF THE INVENTION

The present invention relates to a method of manufacturing semi-finished products and ready-to-use products of titanium and titanium alloys from titanium oxide.

The present invention relates particularly, although by no means exclusively, to a method of manufacturing semi-finished products (such as slabs, billets, sheets, plates, strip and other structures that can be processed into finished products) that includes an electrochemical step that reduces titanium oxide, preferably titanium dioxide, into titanium and titanium alloys.

BACKGROUND OF AND PRIOR ART TO THE INVENTION

Titanium is the $5^{th}$ most abundant metallic element on earth.

Properties of titanium, such as high-strength, lightweight, excellent corrosion resistance, and high temperature operation, make it suitable for use in a wide range of engineering applications. These properties suggest that titanium is more suitable for use in many engineering applications in which engineering steels (such as austenitic stainless steels) and aluminium alloys (such as high strength aluminium alloys) are currently used.

However, world titanium production is currently only around 80 KT per year, a very small amount compared to the annual production of stainless steels and aluminium alloys.

Titanium consumption is low due to its high cost. This is attributable to the (a) complicated process of refining ore sources (rutile and ilmenite) into titanium and titanium alloys, and (b) high production costs associated with pyrometallurgical and electro-metallurgical production of plates, sheets and other semi-finished titanium and titanium alloy products.

FIG. 1 illustrates schematically the different stages involved in manufacturing titanium or titanium alloy plate and the relative costs that each of the individual manufacturing stages contribute to the overall product costs.

Based on current manufacturing costs, if it was possible to reduce the cost of manufacturing semi-finished titanium or titanium alloy products by around 30%, then products like titanium sheet and plate would have the potential to displace other structural engineering metals, in particular austenitic stainless steels and high-strength aluminium alloys, from many of their current areas of application, such as shipbuilding, aircraft manufacture, and chemical process industries. Consequently, such production cost reduction could open up a market of more than 1 MT of titanium metal per year.

As is evident from FIG. 1, the manufacturing stages that provide the biggest potential to achieve cost savings are the semi-finished product (eg plate) fabrication stage (which contributes around 50% to overall production costs) and the titanium production stage (with oxide reduction and electro-metallurgical metal melting contributing around 40% to overall costs).

Commercial scale titanium production relies currently exclusively on the Kroll process. This process involves, in short, (a) purification of the base titanium dioxide ore to remove compounds other than titanium dioxide and other titanium oxides, (b) chlorinating to form titanium tetrachloride in the presence of a reducing agent, (c) purifying the tetrachloride, and (d) subsequently reducing the tetrachloride to metallic titanium using magnesium (or sodium) in a neutral argon or helium atmosphere. The Kroll process produces titanium in the form of a highly porous material, termed titanium sponge, which commonly has impurities such as oxygen, nitrogen, carbon, and hydrogen. The sponge titanium is subsequently crushed and melted (in an inert atmosphere) into ingots for further processing.

Scientific and patent literature, including patent literature of the applicant, discloses that it is possible to produce high grade titanium directly from commonly available and abundant titanium oxides using an electrochemical method as an alternative to the currently employed Kroll process.

The present invention was made during the course of an on-going research project on the electrochemical reduction of titanium carried out by the applicant.

In the course of the research project the applicant has manufactured titanium oxide pellets and conducted electrochemical reduction experiments on the pellets that confirm that it is possible to produce 99.9% and higher purity titanium. The applicant has identified method parameters that require consideration in scaling up the experimental electrochemical cells into pilot plant and commercial plant operations and the electrochemical reduction method that is characterised by these parameters is the subject of other patent applications of the applicant.

Investigations conducted by the applicant in relation to the cost structure and energy consumption of a scaled-up plant that uses the electrochemical reduction method of the applicant rather than the conventional Kroll process suggest that the cost reduction potential of the electrochemical reduction method is about 30%, which amounts to an overall production cost reduction of about 10%.

Whilst such cost reduction potential might of itself be sufficient to justify full scale electrochemical reduction plants for the production of titanium, it is not sufficient to promote higher consumption of titanium as a replacement for the above mentioned conventional engineering metals.

SUMMARY OF INVENTION

An object of the present invention is to develop technology for manufacturing titanium and titanium alloys into semi-finished or ready-to-use products that provides the potential for production cost reductions sufficient to allow replacement of conventional high-strength and corrosion resistant metals, such as austenitic stainless steels and high-strength aluminium alloys, in areas of application thereof, by equivalent titanium or titanium alloy products.

Another object of the present invention is to provide an alternative method of manufacturing titanium and titanium alloy products that avoids melting titanium sponge to manufacture semi-finished and ready-to-use products, such as plates, sheets, strip sections, and bar-stock.

In accordance with the present invention there is proposed a method of manufacturing titanium or titanium alloy semi-finished or ready-to-use products which includes the steps of:

(a) forming shaped bodies of titanium oxide particles;

(b) positioning the shaped bodies in an electrolytic cell which includes: an anode, a cathode, and a molten electrolyte, with the shaped bodies forming at least a part of the cathode, and with the electrolyte including cations of a metal that is capable of chemically reducing titanium oxide;

(c) reducing the titanium oxide to titanium in a solid state in the electrolytic cell so that the shaped bodies become shaped bodies of titanium sponge; and (d) processing the shaped bodies of titanium sponge to reduce the volume or at least one of the dimensions of the bodies by a predetermined percentage value thereby to form the semi-finished or ready-to-use products.

The term "sponge" is understood herein to mean a form of metal characterised by a porous condition.

The above-described method produces shaped bodies (ie "blanks", as understood in powder metallurgy) from finely distributed and sized titanium oxide particles (such as titania ($TiO_2$)) with sufficient strength (and other properties) so that the bodies can be subjected to the electrochemical reduction step without the bodies crumbling prior to and during the step. The electrochemical reduction step in the above-described method produces porous titanium sponge bodies that have properties that allow the bodies to be processed in a controlled manner into shaped semi-finished or ready-to-use products.

The above-described method is an alternative method of manufacturing titanium and titanium alloy semi-finished and ready-to-use products to the known methods.

In addition, from the viewpoint of likely production costs for semi-finished product in the form of titanium plate, initial and preliminary efficiency calculations made by the applicant indicate that the method of the present invention can achieve a 30% production cost reduction over a conventionally produced plate of titanium.

The shaped bodies may be in any suitable form and size.

The shaped bodies may be roughly in the form of the shapes of (i) the semi-finished products, such as plate, sections, and bar stock, or (ii) the ready-to-use products.

Alternatively, the shaped bodies may be in the form of suitable precursor shapes for forming the semi-finished or ready-to-use products by suitable processing such as pressing and/or rolling. These precursor shapes may include billet, plate, and bar stock.

Preferably the shaped bodies are pellets.

Preferably the pellets have a thickness of 8 mm or less.

Preferably the pellets have a thickness of at least 1 mm.

Preferably step (a) includes forming shaped bodies of titanium oxide particles having a predetermined particle size in the range of 1–15 μm.

Preferably the particle size is in the range of 1–10 μm.

Preferably the particle size is in the range of 1–5 μm.

Preferably step (a) includes forming shaped bodies having a porosity of 30–40%.

Preferably step (a) includes forming shaped bodies of titanium oxide particles, with the shaped bodies having pores of predetermined size in the range of 1–15 μm.

Preferably the pore size is in the range of 1–10 μm.

Preferably the pore size is in the range of 1–5 μm.

Preferably step (a) includes forming shaped bodies by slip casting or pressing titanium dioxide particles into the shaped bodies.

Preferably step (a) includes sintering the slip cast or pressed shaped bodies to increase the strength of the shaped bodies to withstand subsequent handling of the shaped bodies prior to being positioned in the electrolytic cell in step (b) and to withstand processing in the cell in step (c).

Preferably step (a) includes sintering the slip cast or pressed shaped bodies at a temperature of at least 850° C.

Preferably the sintering temperature is at least 1050° C.

Preferably the sintering temperature is less than 1250° C.

Preferably step (a) includes sintering the slip cast or pressed shaped bodies for at least 2 hours.

In one embodiment step (a) includes forming shaped bodies by (i) sintering sub-micron size particles into millimeter-size particles, (ii) crushing the millimeter-size particles into 30–40 μm size particles (made up of sub-micron size and larger size particles that form in the sintering step), (iii) slip casting the 30–40 μm size particles into shaped bodies, (iv) drying the shaped bodies, and (v) sintering the shaped bodies.

Preferably step (a)(iii) includes slip casting 30–40 μm size particles and 0.2–0.5 μm size particles into shaped bodies. The inclusion of the 0.2–0.5 μm size particles is to increase the packing density of the shaped bodies.

Preferably the 0.2–0.5 μm size particles are up to 20% by weight of the particles that are slip cast in step (a)(iii).

In another, although not the only other, embodiment step (a) includes forming shaped bodies by (i) cold pressing sub-micron size particles into shaped bodies, and (ii) sintering the shaped bodies.

Preferably the sub-micron sized particles are less than 0.5 μm.

More preferably the sub-micron sized particles are 0.2–0.5 μm.

Preferably the shaped bodies of titanium sponge produced in step (c) include fine particles of titanium having a particle size of 5–30 μm.

Preferably the shaped bodies of titanium sponge produced in step (c) include fine pores having a size of 5–30 μm.

Preferably the shaped bodies of titanium sponge produced in step (c) have a porosity of 40–70%.

Preferably the shaped bodies of titanium sponge produced in step (c) have an oxygen content of less than 0.5 wt. %.

Preferably the oxygen content is less than 0.3%.

More preferably the oxygen content is less than 0.1%.

Preferably step (c) includes reducing the titanium oxide to titanium in the electrolytic cell by operating the cell at a potential that is above a potential at which cations of the metal that is capable of chemically reducing the cathode metal oxide deposit as the metal on the cathode, whereby the metal chemically reduces the cathode metal oxide.

The applicant does not have a clear understanding of the electrolytic cell mechanism at this stage. Nevertheless, whilst not wishing to be bound by the comments in this paragraph, the applicant offers the following comments by way of an outline of a possible cell mechanism. The experimental work carried out by the applicant produced evidence of Ca metal in the electrolyte. The applicant believes that, at least during the early stages of operation of the cell, the Ca metal was the result of electrodeposition of $Ca^{++}$ cations as Ca metal on electrically conductive sections of the cathode. The experimental work was carried out using a $CaCl_2$-based electrolyte at a cell potential below the decomposition potential of $CaCl_2$. The applicant believes that the initial deposition of Ca metal on the cathode was due to the presence of $Ca^{++}$ cations and $O^{--}$ anions derived from CaO in the electrolyte. The decomposition potential of CaO is less than the decomposition potential of $CaCl_2$. In this cell mechanism the cell operation is dependent at least during the early stages of cell operation on decomposition of CaO, with $Ca^{++}$ cations migrating to the cathode and depositing as Ca metal and $O^{--}$ anions migrating to the anode and forming Co and/or $CO_2$ (in a situation in which the anode is a graphite anode). The applicant believes that the Ca metal that deposited on electrically conductive sections of the cathode was deposited predominantly as a separate phase in the early stages of cell operation and thereafter dissolved in the electrolyte and migrated to the vicinity of the titania in the cathode and participated in chemical reduction of titania.

The applicant also believes that at later stages of the cell operation part of the Ca metal that deposited on the cathode was deposited directly on partially deoxidised titanium and thereafter participated in chemical reduction of titanium. The applicant also believes that the $O^{--}$ anions, once extracted from the titania, migrated to the anode and reacted with anode carbon and produced CO and/or $CO_2$ and released electrons that facilitated electrolytic deposition of Ca metal on the cathode.

Preferably the metal deposited on the cathode is soluble in the electrolyte and can dissolve in the electrolyte and thereby migrate to the vicinity of the cathode metal oxide.

Preferably the electrolyte is a $CaCl_2$-based electrolyte that includes CaO as one of the constituents of the electrolyte.

Preferably the cell potential is above the potential at which Ca metal can deposit on the cathode, i.e. the decomposition potential of CaO.

The decomposition potential of CaO can vary over a considerable range depending on factors such as the composition of the anode, the electrolyte temperature, and the electrolyte composition.

In a cell containing CaO saturated $CaCl_2$ at 1373K (1100° C.) and a graphite anode this would require a minimum cell potential of 1.34V.

It is also preferred that the cell potential be below the potential at which $Cl^-$ anions can deposit on the anode and form chlorine gas, i.e. the decomposition potential of $CaCl_2$.

In a cell containing CaO saturated $CaCl_2$ at 1373K (1100° C.) and a graphite anode this would require that the cell potential be less than 3.5V.

The decomposition potential of $CaCl_2$ can vary over a considerable range depending on factors such as the composition of the anode, the electrolyte temperature, and the electrolyte composition.

For example, a salt containing 80% $CaCl_2$ and 20% KCl at a temperature of 900K (657° C.), decomposes to Ca (metal) and $Cl_2$ (gas) above 3.4V and a salt containing 100% $CaCl_2$ at 1373K (1100° C.) decomposes at 3.0V.

In general terms, in a cell containing CaO—$CaCl_2$ salt (not saturated) at a temperature in the range of 600–1100° C. and a graphite anode it is preferred that the cell potential be between 1.3 and 3.5V.

The $CaCl_2$-based electrolyte may be a commercially available source of $CaCl_2$, such as calcium chloride dihydrate, that partially decomposes on heating and produces CaO or otherwise includes CaO.

Alternatively, or in addition, the $CaCl_2$-based electrolyte may include $CaCl_2$ and CaO that are added separately or pre-mixed to form the electrolyte.

It is preferred that the anode be graphite or an inert anode.

Preferably the method includes removing the shaped bodies of titanium sponge produced in step (c) from the electrolytic cell and cleaning the shaped bodies to remove electrolyte from the shaped bodies.

In one embodiment step (d) includes processing the shaped bodies of titanium sponge by cold pressing and/or cold rolling the shaped bodies of titanium sponge.

Preferably step (d) further includes high temperature sintering of the cold pressed and/or cold rolled shaped bodies of titanium sponge.

Preferably high temperature sintering is carried out at a temperature of 1100–1300° C. for 2–4 hours.

Preferably step (d) includes cold pressing and/or cold rolling the shaped bodies of titanium sponge to reduce the porosity to 20% or less and thereafter sintering the cold pressed and/or cold rolled shaped bodies to form the semi-finished or ready-to-use product with a porosity of 1% or less.

In another, although not the only other, embodiment step (d) includes processing the shaped bodies of titanium sponge by hot pressing the shaped bodies of titanium sponge.

Preferably hot pressing is carried out at a temperature of 800–1000° C. at a pressure of 10–100 MPa for up to 60 minutes.

Preferably step (d) includes hot pressing the shaped bodies to form the semi-finished or ready-to-use product with a porosity of 1% or less.

In another, although not the only other, embodiment step (d) includes processing the shaped bodies of titanium sponge by cold pressing and/or cold rolling and thereafter hot pressing the shaped bodies of titanium sponge.

Preferably step (d) includes cold pressing the shaped bodies of titanium sponge to reduce the porosity 50% or less and thereafter hot pressing the shaped bodies to form the semi-finished or ready-to-use product with a porosity of 1% or less.

Preferably the semi-finished or ready-to-use products produced in step (d) have a porosity of less than 5%.

Preferably the porosity is less than 3%.

More preferably the porosity is less than 1%.

According to the present invention there is also provided a shaped body of titanium sponge as described above.

According to the present invention there is also provided a shaped body of titanium sponge as described above and produced by the method described above.

According to the present invention there is also provided a semi-finished or ready-to-use product formed by electrochemically reducing a shaped body of titanium oxide and thereafter processing the shaped body by cold pressing and/or cold rolling and thereafter high temperature sintering the shaped body so that the semi-finished or ready-to-use product has a porosity of 1% or less.

According to the present invention there is also provided a semi-finished or ready-to-use product formed by electrochemically reducing a shaped body of titanium oxide and thereafter processing the shaped body by hot pressing the shaped body so that the semi-finished or ready-to-use product has a porosity of 1% or less.

The present invention is described further with reference to the following Examples.

DESCRIPTION OF EXPERIMENTAL METHOD AND EQUIPMENT

Figure 1:
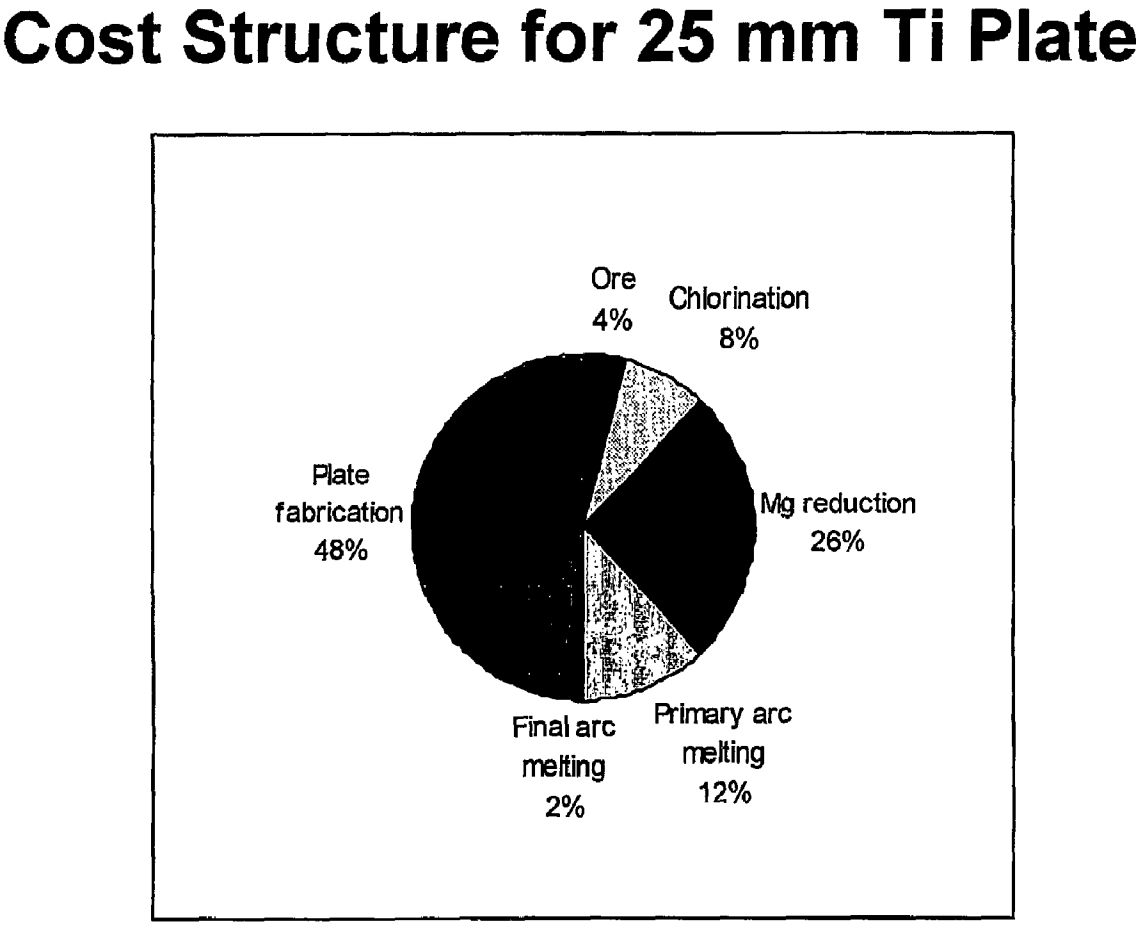
FIG. 1 is a chart illustrating the cost structure of stages in the manufacture of a 25 mm thickness titanium plate using known technology.
Figure 2:
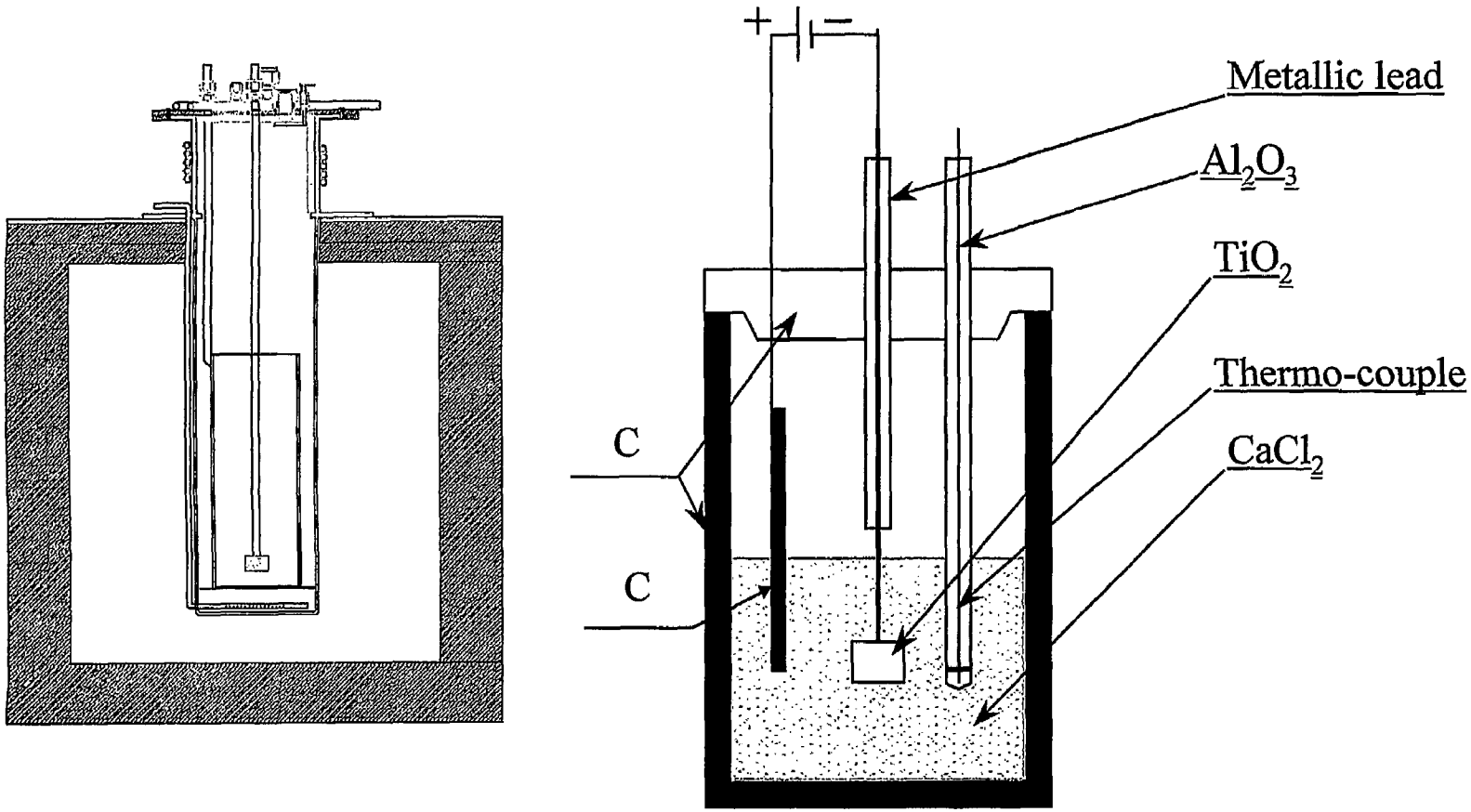
FIG. 2 is a schematic of an experimental set up for electrochemical reduction of titanium oxide pellets.

A schematic of an experimental set up for processing titanium oxide blanks of up to 1 Kg is shown in FIG. 2.

The electrochemical cell included a graphite crucible equipped with a graphite lid. The crucible formed the cell anode. A stainless steel rod was used to secure electrical contact between a d/c power supply and the crucible. An alumina tube was used as an insulator around the cathode. The cathode consisted of a pure platinum wire and electrically conductive mesh basket containing plate-like, pressed titanium oxide bodies described below suspended from the lower end of the wire. The cell electrolyte was a commercially available source of $CaCl_2$ that decomposed on heating at the operating temperature of the cell and produced CaO. A thermocouple was immersed in the electrolyte in close proximity to the cathode.

In use, the assembly was positioned in the hot zone of a resistance furnace containing an inert atmosphere of argon during the reduction step.

The power supply to the cell was maintained a constant voltage throughout the experiments. The voltage and resultant current were logged using LabVIEW data acquisition software.

The shaped bodies used in the experiments were in the form of pellets prepared by slip-casting or cold pressing titanium dioxide particles. Analytical grade $TiO_2$ powder of sub-micron size was the starting material for the manufacture of the pellets. The majority of the pellets were disk-shaped with a diameter of up to 40 mm and a thickness of 1–8 mm. A number of the pellets were also rectangular in section.

The slip-cast pellets were made by the following general procedure.

Sintering 0.2–0.5 μm $TiO_2$ powder for 2 hours at 1050° C. and producing lumps of approximately 1 mm.

Crushing the lumps to 30–40 μm size particles.

Forming a slurry of the 30–40 μm particles, 0.2–0.5 μm particles (10% by weight of the total weight of the particles), deflocculent, and water.

Slip-casting the slurry to form pellets.

Drying the pellets by air drying for 3 days and then in an oven at 120° C. for 4 hours.

Sintering the dried pellets by firstly heating the pellets from ambient to 1050° C. at a rate of 5–10° C./min and thereafter holding at 1050° C. for 2 hours and cooling the sintered pellets at approximately 20° C./min.

The cold pressed pellets were made by cold pressing 0.2–0.5 μm $TiO_2$ powder to form pellets and thereafter sintering the pellets in accordance with the procedure set out above.

The slip-cast/cold pressed and sintered pellets had the following general characteristics:

30–40% porosity.

Uniform fine microstructure, with 1–15 μm $TiO_2$ particles and 1–15 μm pores.

Figure 3:
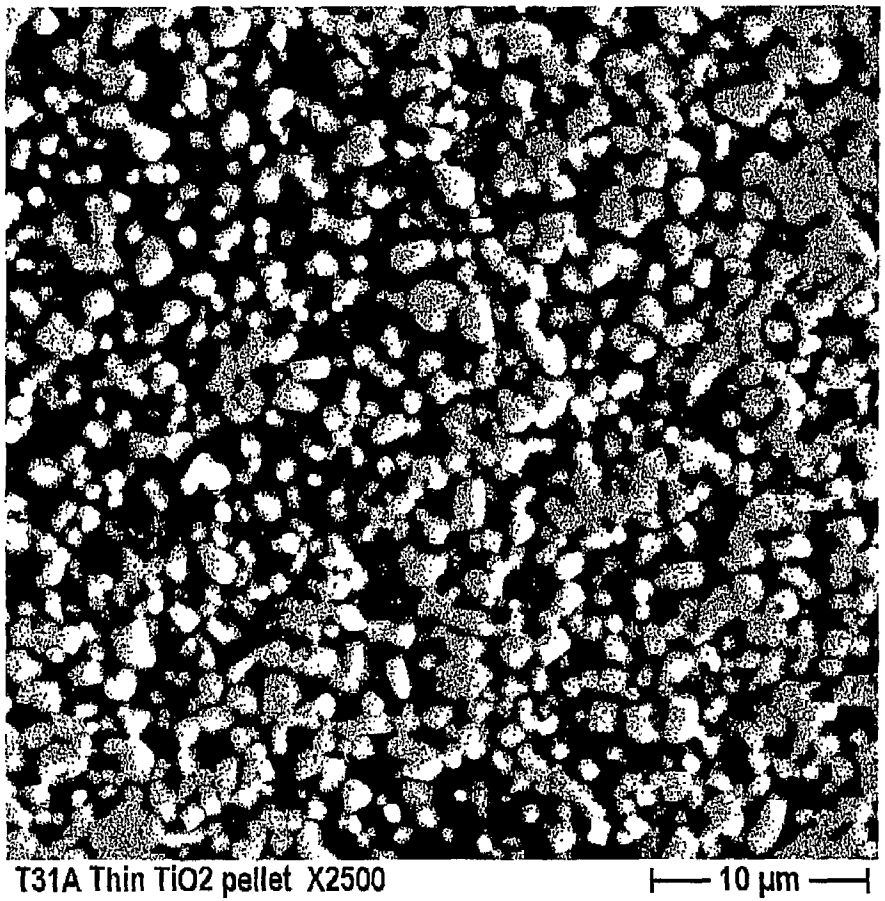
FIG. 3 is an electron microscope image of a section of a slip-cast and sintered titanium dioxide pellet.

FIG. 3 is a scanning electron microscope (SEM) image of a slip-cast and sintered pellet. It is evident from the figure that the pellet had a uniform fine microstructure.

The pellets were electrochemically reduced in the electrolytic cell set-up shown in FIG. 2.

The electrolyte was at a temperature of 950° C.—sufficient for the electrolyte to remain in a molten state. Voltages of up to 3V were applied between the crucible wall (anode) and the cathode (wire and $TiO_2$ pellets).

A 3V potential produced an initial current of approximately 1.2 A. A continuous drop in the current was observed during the initial 2 hours of reduction, after which a gradual increase in the current up to 1 A was observed. The electrochemical reduction runs were terminated after different times, up to 24 hours.

At the completion of electrochemical reduction runs, the pellets were removed from the cell and were washed in accordance with the following procedure.

Washing in boiling water for several hours.

Washing in 30% acetic acid at 100° C. for several hours and/or 5% HCl at 100° C. for 0.5 hours.

Washing in alcohol under vacuum.

Drying in an oven at 120° C.

The electrochemical reduction runs produced pellets of high purity titanium sponge.

Pellets of titanium sponge having the following general characteristics were found to be preferable from the viewpoint of subsequent processing to form semi-finished products.

40–70% porosity.

Uniform fine microstructure, with 5–30 μm particles and 5–30 μm pores.

Low oxygen content: less than 0.05 wt. %.

Figure 4:
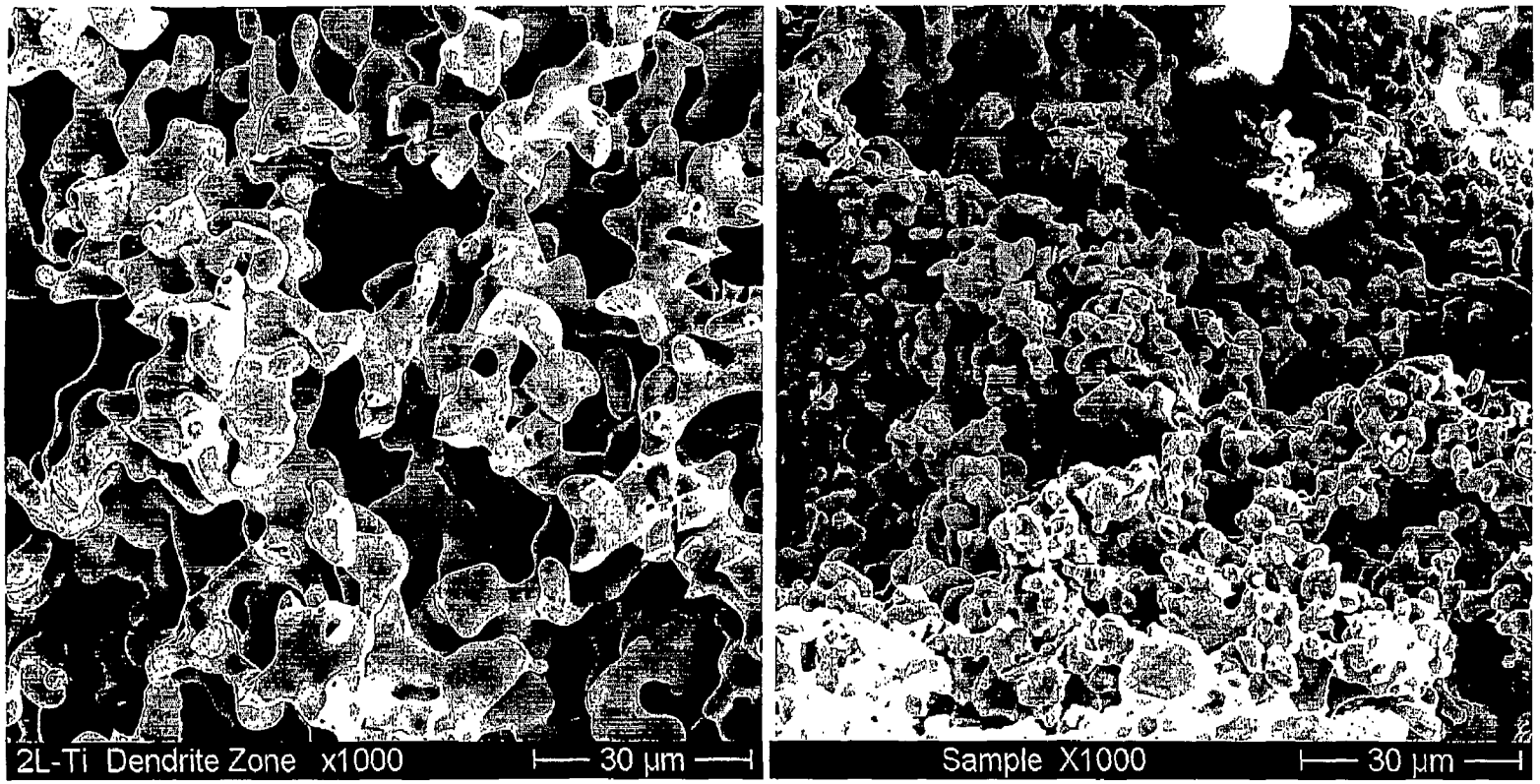
FIG. 4 is electron microscope images of sections of two titanium sponge pellets produced by electrochemical reduction of titanium dioxide pellets, the titanium sponge pellets having different oxygen contents.
Figure 5:
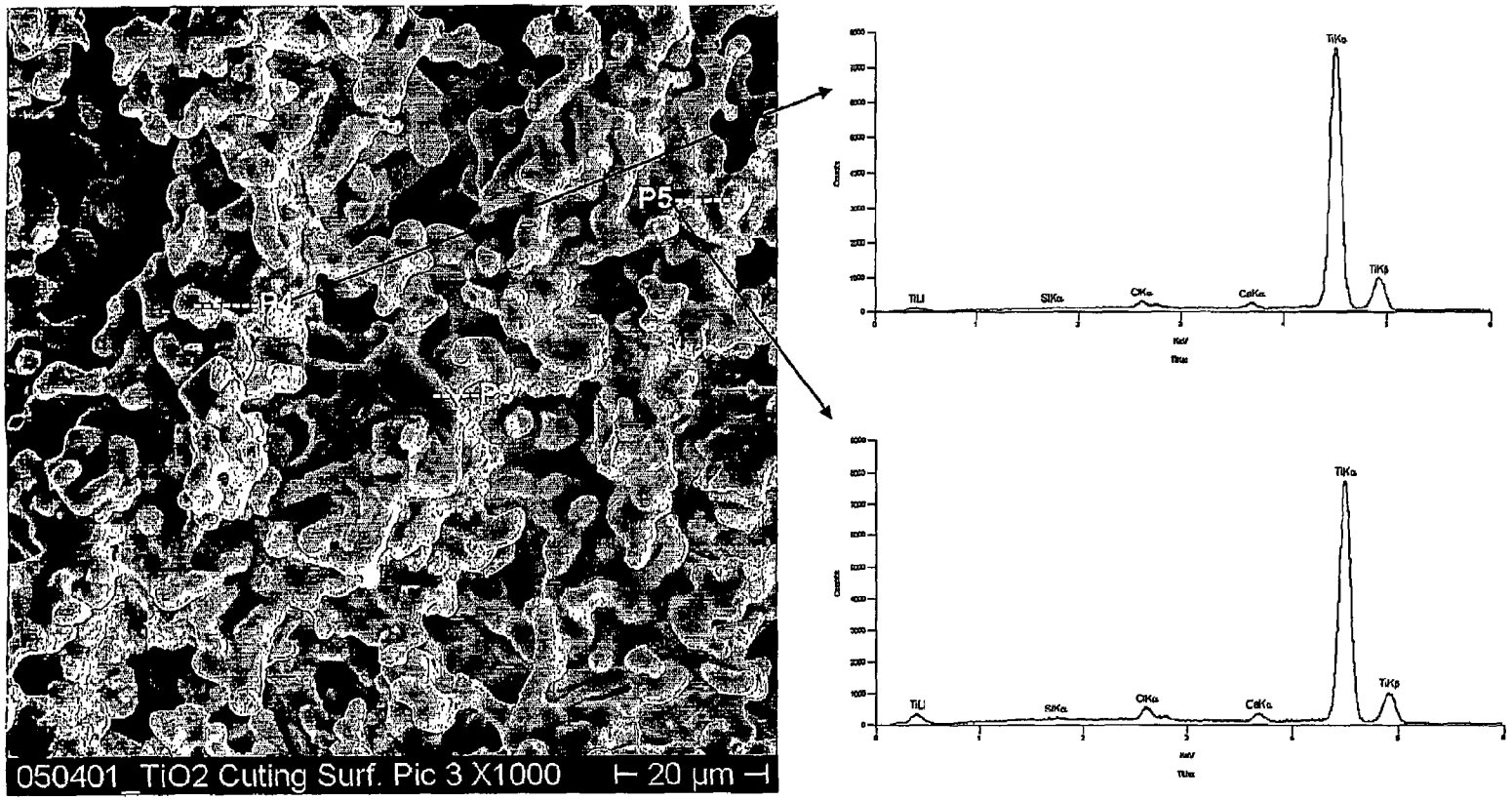
FIG. 5 is a further electron microscope image of a section of the titanium sponge pellet shown on the left hand side of FIG. 4 and spectrographs of the composition of the titanium sponge.

SEM images of sections of two titanium sponge pellets having different oxygen contents are shown in FIG. 4. The titanium sponge shown in the left-hand image had an oxygen content of 0.05 wt. %. The titanium sponge shown in the right-hand image was provided to the applicant from an outside source and had an oxygen content of 0.9 wt. %. FIG. 5 is a further SEM image of the pellet shown on the left-hand side of FIG. 4 (ie the pellet having the lower oxygen content of 0.05 wt %). The spectrographs on the right-hand side of the figure confirm that the pellet was virtually pure titanium.

Figure 6:
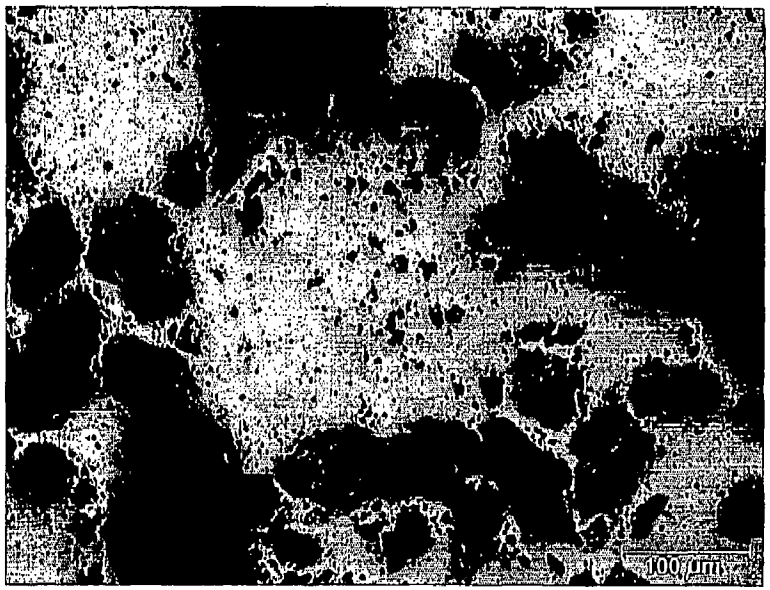
FIG. 6 is photomicrographs of sections of the two titanium sponge pellets that were used to produce the electron microscope images shown in FIG. 4
Figure 6:
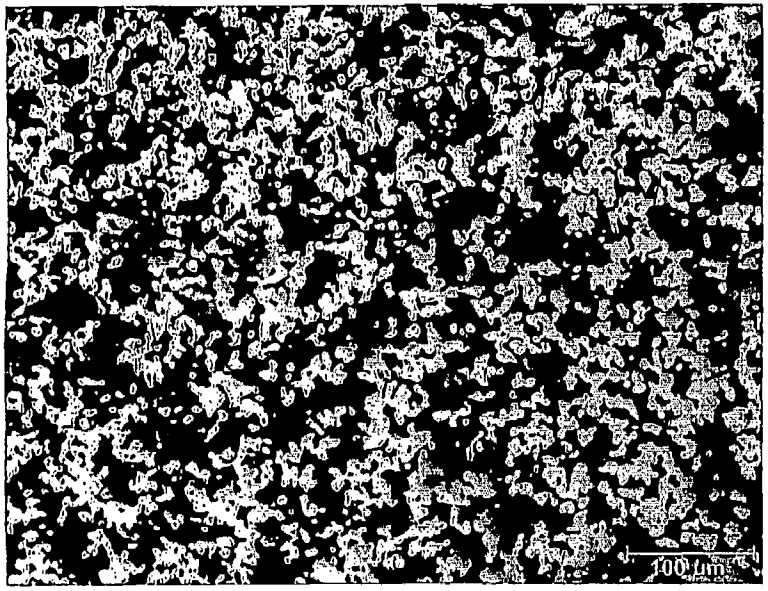

Photomicrographs of sections of the two electrochemically reduced pellets of titanium sponge referred to in the preceding paragraph are shown in FIG. 6. The titanium sponge pellet shown on the right-hand side of the figure had an oxygen content of 0.9 wt. % and a hardness of 456 VHN. The microstructure was generally heterogenous with large titanium particles (typically 250–300 μm) surrounded by large pores of approximately the same size. The pellet disintegrated in cold pressing experiments. The titanium sponge pellet on the left-hand side of the figure was produced by the applicant in the experimental set up shown in FIG. 2. The titanium sponge contained 0.05 wt. % oxygen and a hardness of 118 VHN. The microstructure was generally uniform with fine titanium particles and fine pores. The particles and pores were in the range of 5–30 μm. The titanium sponge had a porosity of around 50%.

A titanium sponge pellet from the same batch as that shown in the left-hand side of FIG. 6 was cold pressed and thereafter cold rolled into a thin titanium sheet of 0.4 mm. The initially 1.7 mm thick pellet was initially cold pressed by 60% to a thickness of 0.7 mm without rupture of the sample surface. A force of the order of 400 MPa was required to achieve the 60% reduction. Subsequent cold rolling reduced the thickness by 40% to 0.4 mm, thereby producing a thin sheet. In overall terms, the pellet thickness was reduced by 75%.

Figure 7:
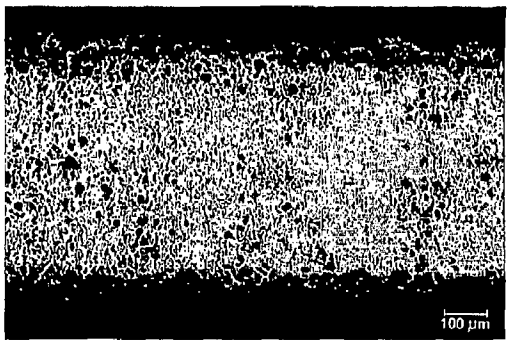
FIG. 7 is photomicrographs of sections of a titanium sponge pellet in (i) an as-produced form, (ii) after cold pressing, and (iii) after additional cold rolling.
Figure 7:
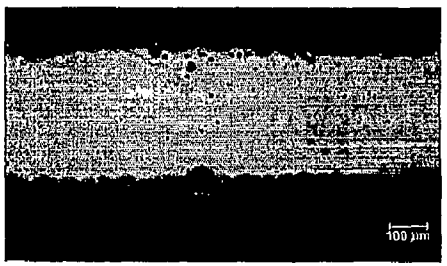
Figure 7:
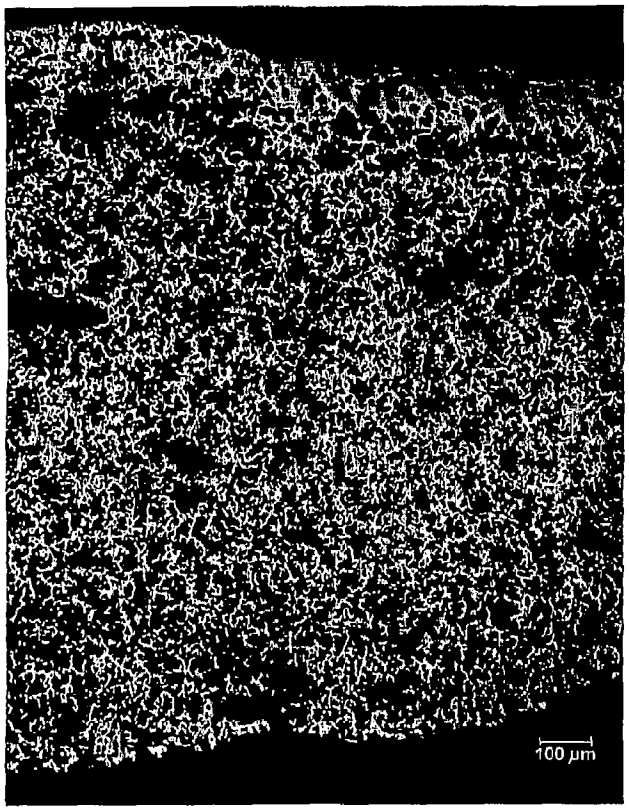

Photomicrographs through sections of the pellet prior to cold pressing, after cold pressing, and after cold rolling are shown in FIG. 7. The cold pressed and cold rolled sheet produced was indistinguishable from a titanium sheet produced in conventional manner. This is a significant result given that the conventional method of producing titanium sheet includes a melting step.

Cold pressed titanium sponge pellets were subjected to high temperature sintering. The cold pressed pellets were subjected to a range of different sintering conditions. Specifically sintering was carried out for at least 2 hours at a temperature range of 1100–1300° C. under vacuum conditions with samples wrapped in tantalum foil.

Figure 8:
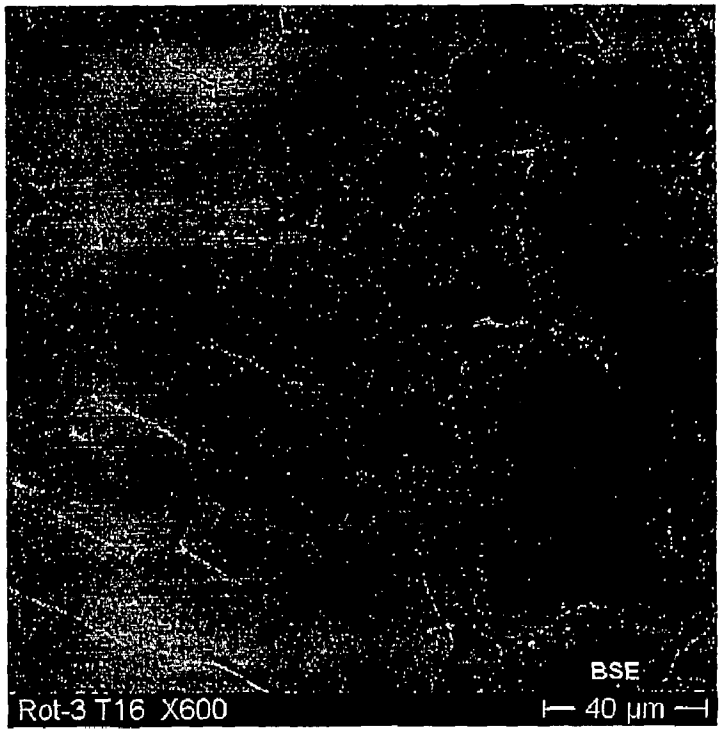
FIG. 8 is electron microscope images of sections of a titanium sponge pellet in (i) an as-cold pressed form and (ii) after sintering.
Figure 8:
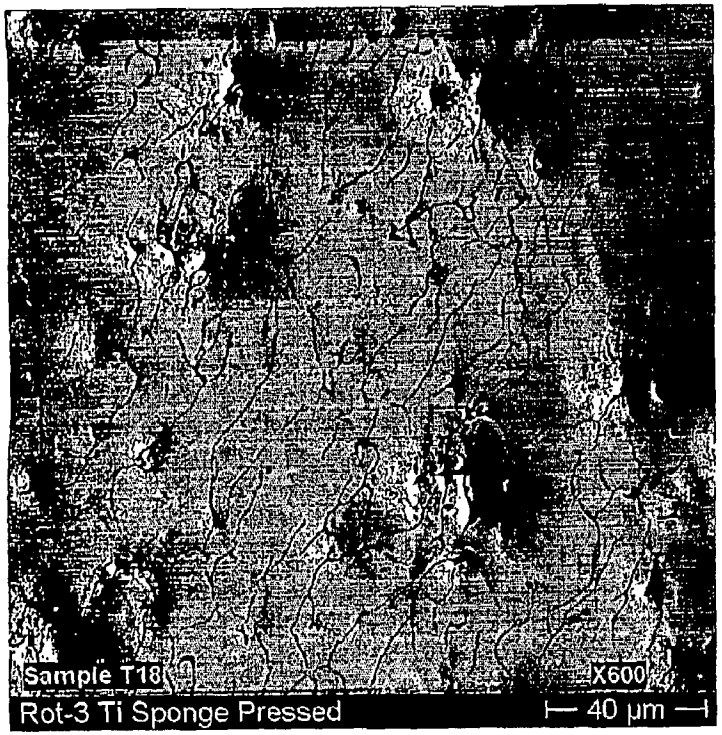

FIG. 8 is SEM images of a titanium sponge pellet that was cold pressed to a 60% thickness reduction and thereafter sintered at 1300° C. for a 150 minutes under vacuum conditions with samples wrapped in tantalum foil. The cold pressed pellet is shown on the left-hand side of the figure and the cold pressed and sintered pellet is shown on the right-hand side of the figure. The final porosity of the cold pressed and sintered pellet was less than 5%. In other experiments, the applicant was able to achieve porosities of the order of 1%.

Titanium sponge pellets were subjected to hot pressing. The hot pressing involved a combination of heat and pressure that sintered the pellets. The hot pressing was carried out in a Gleeble Thermomechanical Simulator. The titanium sponge pellets were wrapped in tantalum foil and were placed in the simulator. The simulator chamber was evacuated to $10^{-8}$ atmosphere vacuum. Hot pressing conditions varied. Specifically, titanium sponge pellets were hot pressed at temperatures of 800–1000° C. under a pressure of 10–100 MPa for up to 60 minutes.

Figure 9:
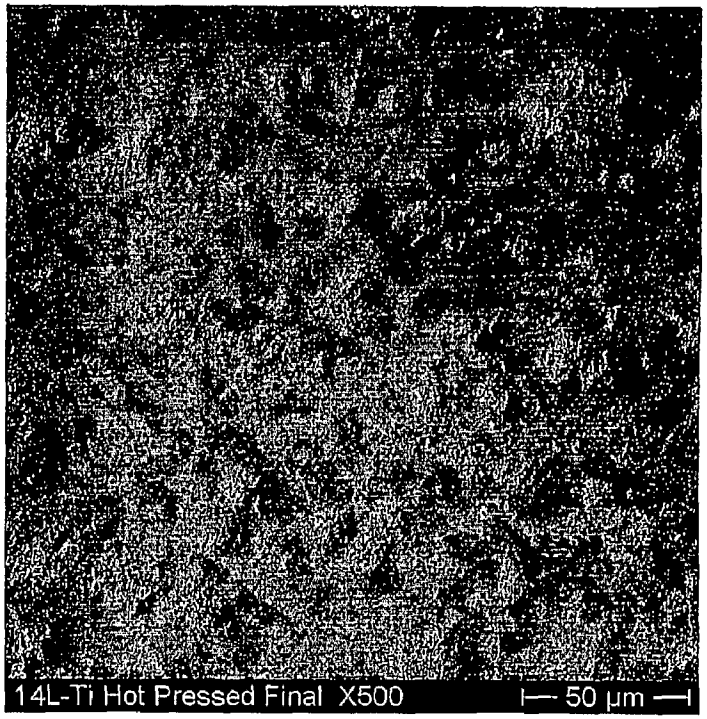
FIG. 9 is electron microscope images of sections of a titanium sponge pellet in (i) an as-cold pressed form and (ii) after hot pressing.
Figure 9:
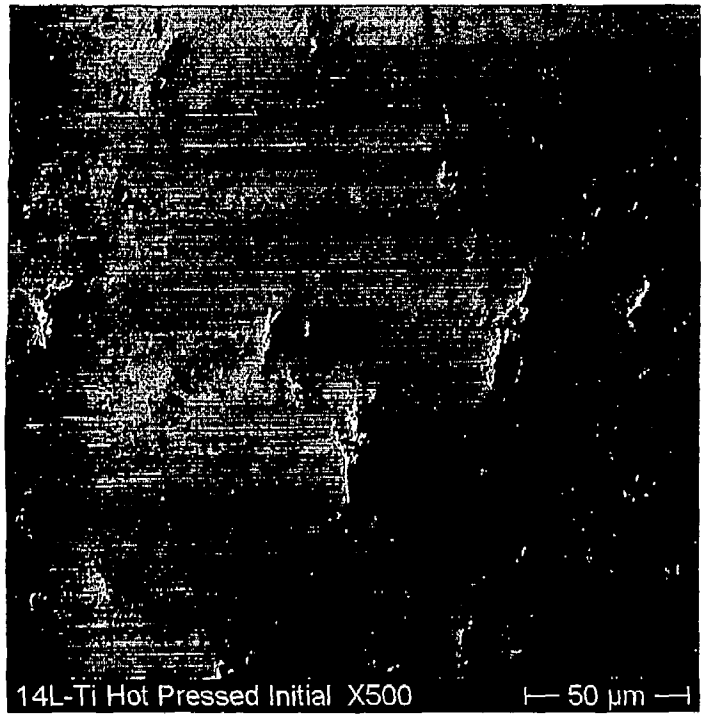

FIG. 9 is SEM image of a titanium sponge pellet that was cold pressed to a 30% thickness reduction and thereafter hot pressed at 1000° C. under 25 MPa for 30 minutes. The cold pressed pellet is shown on the left-hand side of the figure and the cold pressed and hot pressed pellet is shown on the rift-hand side of the figure. The hot pressed pellet had a final porosity of less than 1%.

Many modifications may be made to the present invention described above without departing from the spirit and scope of the invention.

The invention claimed is:

1. A method of manufacturing titanium or titanium alloy semi-finished or ready-to-use products which includes the steps of:

(a) forming shaped bodies of titanium oxide particles by (i) sintering submicron size particles into millimeter-size particles, (ii) crushing the millimeter-size particles into 30–40 μm size particles, (iii) slip casting the 30–40 μm size particles into shaped bodies, (iv) drying the shaped bodies, and (v) sintering the shaped bodies;

(b) positioning the shaped bodies in an electrolytic cell which includes: an anode, a cathode, and a molten electrolyte, with the shaped bodies forming at least a part of the cathode, and with the electrolyte including cations of a metal that is capable of chemically reducing titanium oxide;

(c) reducing the titanium oxide to titanium in a solid state in the electrolytic cell so that the shaped bodies become shaped bodies of titanium sponge; and (d) processing the shaped bodies of titanium sponge to reduce the volume or at least one of the dimensions of the bodies thereby to form the semi-finished or ready-to-use products.

2. The method defined in claim 1 wherein the shaped bodies formed in step (a) are pellets.

3. The method defined in claim 2 wherein the pellets have a thickness of 8 mm or less.

4. The method defined in claim 1 wherein step (a) includes forming shaped bodies having a porosity of 30–40%.

5. The method defined in claim 1 wherein step (a) includes forming shaped bodies of titanium oxide particles, with the shaped bodies having pores sized in the range of 1–15 μm.

6. The method defined in claim 5 wherein the sizes of the pores are in the range of 1–10 μm.

7. The method defined in claim 1 wherein step (a) (iii) includes slip casting 30–40 μm size particles and 0.2–0.5 μm size particles into shaped bodies.

8. The method defined in claim 7 wherein the 0.2–0.5 μm size particles are up to 20% by weight of the particles that arte slip cast in step (a) (iii).

9. The method defined in claim 1 wherein the sub-micron sized particles are smaller than 0.5 μm.

10. The method defined in claim 9 wherein the sub-micron sized particles are 0.2–0.5 μm in size.

11. The method defined in claim 1 further comprising removing the shaped bodies of titanium sponge produced in step (c) from the electrolytic cell and cleaning the shaped bodies to remove electrolyte from the shaped bodies.

12. The method defined in claim 1 wherein step (d) includes processing the shaped bodies of titanium sponge by cold pressing and/or cold rolling the shaped bodies of titanium sponge.

13. A method of manufacturing titanium or titanium alloy semi-finished or ready-to-use products which includes the steps of:

(a) forming shaped bodies of titanium oxide particles;

(b) positioning the shaped bodies in an electrolytic cell which includes: an anode, a cathode, and a molten electrolyte, with the shaped bodies forming at least a part of the cathode, and with the electrolyte including cations of a metal that is capable of chemically reducing titanium oxide;

(c) reducing the titanium oxide to titanium in a solid state in the electrolytic cell by operating the cell at a potential that is above a potential at which cations of the metal that is capable of chemically reducing the cathode metal oxide deposit as the metal on the cathode, the metal chemically reducing the cathode metal oxide, so that the shaped bodies become shaped bodies of titanium sponge; and (d) processing the shaped bodies of titanium sponge to reduce the volume or at least one of the dimensions of the bodies thereby to form the semi-finished or ready-to-use products.

14. The method defined in claim 13 wherein the metal deposited on the cathode is soluble in the electrolyte and can dissolve in the electrolyte and thereby migrate to the vicinity of the cathode metal oxide.

15. The method defined in claim 14 wherein the electrolyte is a $CaCl_2$-based electrolyte that includes CaO as one of the constituents of the electrolyte.

16. The method defined in claim 15 wherein the cell potential is above the potential at which Ca metal can deposit on the cathode.

17. The method defined in claim 13 wherein the shaped bodies formed in step (a) are pellets.

18. The method defined in claim 17 wherein the pellets have a thickness of 8 mm or less.

19. The method defined in claim 13 wherein step (a) includes forming shaped bodies of titanium oxide particles having particle sizes in the range of 1–15 μm.

20. The method defined in claim 13 wherein step (a) includes forming shaped bodies having a porosity of 30–40%.

21. The method defined in claim 13 wherein step (a) includes forming shaped bodies of titanium oxide particles, with the shaped bodies having pores sized in the range of 1–15 μm.

22. The method defined in claim 21 wherein the sizes of the pores are in the range of 1–10 μm.

23. The method defined in claim 13 wherein step (a) includes forming shaped bodies by slip casting or pressing titanium oxide particles into the shaped bodies.

24. The method defined in claim 23 wherein step (a) includes sintering the slip cast or pressed shaped bodies to increase the strength of the shaped bodies to withstand subsequent handling of the shaped bodies prior to being positioned in the electrolytic cell in step (b) and to withstand processing in the cell in step (c).

25. The method defined in claim 13 further comprising removing the shaped bodies of titanium sponge produced in step (c) from the electrolytic cell and cleaning the shaped bodies to remove electrolyte from the shaped bodies.

26. The method defined in claim 13 wherein step (d) includes processing the shaped bodies of titanium sponge by cold pressing and/or cold rolling the shaped bodies of titanium sponge.

27. A method of manufacturing titanium or titanium alloy semi-finished or ready-to-use products which includes the steps of:

(a) forming shaped bodies of titanium oxide particles;

(b) positioning the shaped bodies in an electrolytic cell which includes: an anode, a cathode, and a molten $CaCl_2$-based electrolyte that includes CaO as one of the constituents of the electrolyte, with the shaped bodies forming at least a part of the cathode, and with the electrolyte including cations of a metal that is capable of chemically reducing titanium oxide;

(c) reducing the titanium oxide to titanium in a solid state in the electrolytic cell so that the shaped bodies become shaped bodies of titanium sponge; and (d) processing the shaped bodies of titanium sponge to reduce the volume or at least one of the dimensions of the bodies thereby to form the semi-finished or ready-to-use products.

28. The method defined in claim 27 wherein the shaped bodies formed in step (a) are pellets.

29. The method defined in claim 28 wherein the pellets have a thickness of 8 mm or less.

30. The method defined in claim 27 wherein step (a) includes forming shaped bodies of titanium oxide particles having particle sizes in the range of 1–15 μm.

31. The method defined in claim 27 wherein step (a) includes forming shaped bodies having a porosity of 30–40%.

32. The method defined in claim 27 wherein step (a) includes forming shaped bodies of titanium oxide particles, with the shaped bodies having pores sized in the range of 1–15 μm.

33. The method of defined in claim 32 wherein the sizes of the pores are in the range of 1–10 μm.

34. The method defined in claim 27 wherein step (a) includes forming shaped bodies by slip casting or pressing titanium oxide particles into the shaped bodies.

35. The method defined in claim 34 wherein step (a) includes sintering the slip cast or pressed shaped bodies to increase the strength of the shaped bodies to withstand subsequent handling of the shaped bodies prior to being positioned in the electrolytic cell in step (b) and to withstand processing in the cell in step (c).

36. The method defined in claim 27 wherein the cell potential is above the potential at which Ca metal can deposit on the cathode.

37. The method defined in claim 27 further comprising removing the shaped bodies of titanium sponge produced in step (c) from the electrolytic cell and cleaning the shaped bodies to remove electrolyte from the shaped bodies.

38. The method defined in claim 27 wherein step (d) includes processing the shaped bodies of titanium sponge by cold pressing and/or cold rolling the shaped bodies of titanium sponge.

* * * * *